US010918138B2

(12) United States Patent
Lloyd

(10) Patent No.: US 10,918,138 B2
(45) Date of Patent: Feb. 16, 2021

(54) WEARABLE BABY BLANKET WITH INSULATED INTERCHANGEABLE UPPER AND LOWER POCKETS FOR A CUSTOMIZED FIT AND UTILITY THAT EASILY CONVERTS INTO A TRADITIONAL BLANKET

(71) Applicant: Audrey Lloyd, Bridgewater, NJ (US)

(72) Inventor: Audrey Lloyd, Bridgewater, NJ (US)

( * ) Notice: Subject to any disclaimer, the term of this patent is extended or adjusted under 35 U.S.C. 154(b) by 0 days.

(21) Appl. No.: 15/470,449

(22) Filed: Mar. 27, 2017

(65) Prior Publication Data

US 2017/0280785 A1 Oct. 5, 2017

Related U.S. Application Data

(60) Provisional application No. 62/315,995, filed on Mar. 31, 2016.

(51) Int. Cl.
*A41B 13/06* (2006.01)
*A47G 9/06* (2006.01)

(52) U.S. Cl.
CPC ..... *A41B 13/06* (2013.01); *A47G 9/068* (2013.01); *A41B 2300/322* (2013.01); *A41B 2300/324* (2013.01)

(58) Field of Classification Search
CPC . A41B 13/06; A41B 13/065; A41B 2300/324; A41B 2300/322; A47G 9/068; A47G 9/083; A47G 9/066; A47G 9/0223
USPC ..... 2/69, 69.5; 5/655, 485, 494
See application file for complete search history.

(56) References Cited

U.S. PATENT DOCUMENTS 1,704,504 A * 3/1929 Hedden ..... A41D 13/04 2/69
2,722,694 A * 11/1955 Bryant ..... A61F 5/3776 128/872
4,534,065 A * 8/1985 Comfort ..... A47G 9/066 2/69.5
5,243,724 A 9/1993 Barnes
5,283,909 A 2/1994 Hill
5,604,932 A * 2/1997 Lawicki ..... A47G 9/066 2/46
5,970,542 A 10/1999 Mays
6,105,168 A 8/2000 Hazen
6,233,763 B1 * 5/2001 Spaan ..... A47G 9/0207 446/72
6,341,397 B1 1/2002 Kliegl et al.
6,408,439 B1 6/2002 Garforth-Crippen
6,643,870 B2 11/2003 Bertrand
6,948,200 B2 * 9/2005 Wyman ..... A47G 9/068 2/69.5
7,431,395 B2 10/2008 Morgan
(Continued)

*Primary Examiner* — Khoa D Huynh
*Assistant Examiner* — Aiying Zhao
(74) *Attorney, Agent, or Firm* — Porzio Bromberg & Newman P.C.

(57) ABSTRACT

A wearable blanket includes a body and removable lower pocket coupled to a rear surface of the body along vertical edges of the pocket. Legs of a user are received between the rear surface of the body and the pocket for securing the wearable blanket to the user. An removable upper pocket can be attached to the body and positioned adjacent a chest of a user after the lower pocket is secured to the user. A liner made of warming fabric can be added to or removed from the both the upper and/or lower pocket to regulate comfort.

2 Claims, 5 Drawing Sheets

(56) References Cited

U.S. PATENT DOCUMENTS

| | | | | |
|---|---|---|---|---|
| 8,118,364 | B2 | 2/2012 | Davis | |
| 8,707,481 | B1 * | 4/2014 | Juarez | A47G 9/066 2/69 |
| 2003/0061659 | A1 * | 4/2003 | Dunlap | A47G 9/066 5/485 |
| 2008/0222809 | A1 | 9/2008 | Cameron | |
| 2008/0289082 | A1 * | 11/2008 | Harris | A41D 27/20 2/251 |
| 2009/0299442 | A1 * | 12/2009 | Vergona | A47G 9/0215 607/114 |
| 2010/0263104 | A1 | 10/2010 | Flannery | |
| 2013/0318712 | A1 * | 12/2013 | Cordoves | A47G 9/0207 5/485 |
| 2014/0068834 | A1 * | 3/2014 | Skinner | A41B 13/06 2/69.5 |

* cited by examiner

WEARABLE BABY BLANKET WITH INSULATED INTERCHANGEABLE UPPER AND LOWER POCKETS FOR A CUSTOMIZED FIT AND UTILITY THAT EASILY CONVERTS INTO A TRADITIONAL BLANKET

BACKGROUND OF THE INVENTION

Field of the Invention

The present invention relates to a baby blanket and specifically to a convertible customizable baby blanket.

Description of Related Art

Baby blankets are known for providing comfort and warmth. However, conventional blankets are hard to keep in place, can fall off, create a hazard when it becomes bunched up preventing the infant carrier from properly snapping into its base and draping can cause the person carrying a child in an infant carrier to trip and fall, or the blanket can become entangled in the wheel of a baby stroller.

Buckling children in car seats wearing coats and snowsuits can result in the improper use and fit of the seat belt. Recent studies reveal "coats [ . . . ] are likely to create extra space between the harness and the child, putting the child at risk for injury or death." Conventional solutions introduce garments, swaddling blankets, bunting systems, wraps and other accessories as an alternative to this practice.

Conventional solutions include the introduction of material (fabric, inserts, lining, and etc.) behind or under a child's body. These solutions have the limitation that: these products go behind, or under the child's body which can compress in a crash and lead to increased risk of injury and secondly, the construction and design of many of the conventional solutions using polyester can potentially lead to excessive sweating and overheating as many do not offer the flexibility to adjust or regulate the child's comfort in indoor/outdoor environments, without complete removal of the article.

SUMMARY OF THE INVENTION

In view of the aforementioned disadvantages raised in the known types of children blankets, the present invention provides a safer solution that is applied after the child is seated and safely secured in its seat.

The present invention is a wearable blanket that adheres to the child, not to the car seat, or seat belt. This means, the child is not sitting on, or resting against material that can compress or cause the child to slip out of the seat in a crash. In addition, the present invention does not loop, thread, tie, or attach to the seat belt, harness or through the original manufactured infant carrier or car seat liner.

The present invention relates generally to the field of blankets for infants and toddlers. However, the dimensions can be adapted for use by older children and adults. It is specifically designed for use in an infant carrier, car seat, stroller and beyond as its customizable feature provides added versatility and an array of useful functions with or without the use of the upper and lower pockets. With the upper and lower pockets removed, the invention coverts to a traditional blanket for use as a play mat, a cover for a changing table, or to snuggle a child while napping.

The present invention can be customized to fit the child and the needs of the parent or caregiver through interchangeable and removal pockets and one or more liners received in the pockets. In particular, an upper pocket can include a liner.

The present invention comprises two interchangeable and removable upper and lower pockets. A liner made of warming fabric can be added to or removed from the both the upper and/or lower pocket to regulate comfort. The lower pocket can snap to the body of the blanket creating an open space where the feet are inserted so that the blanket secures to the child. Once the lower pocket is adhered to the body of the blanket the feet of a user can be received between the lower pocket and the blanket to secure the blanket around the legs of the user. As one would do to a traditional blanket, the sides of the blanket of the present invention can be tucked or folded around a user.

The present invention can easily be customized, or converted to a traditional blanket by simply unsnapping the upper and lower pockets. The intention of the present design is to develop an alternative solution to a traditional blanket by providing a safer, comfortable and easy to use solution that does not comprise the car seat, seat belts or safety restraint system when used upon a child while driving.

The wearable blanket can be formed of natural fabrics, including for example cotton, organic, natural and breathable materials for keeping a user comfortable, preventing excessive sweating and overheating.

The present invention can be placed on the child after being seated and the harness is snug and secure. Designed specifically with safety in mind, the present invention provides the look, feel and comfort of a traditional blanket with the added utility of pockets with an optimal liner targeting two critical areas to regulate comfort: the torso, the body's core area of warmth, and feet, for the coziness of a baby. In addition, the safe and functional lower pocket secures the wearable blanket to the child totally removing any interference with or reliance on the car seat, thus eliminating the risk of interfering with the car seat safety restraint system. The present invention does not interface or interfere with the five-point safety harness in a child carrier, or car seat.

The present invention allows users to interchange and customize the placement and use of the removable upper and lower pockets. Essentially this present invention represents six or more designs in one having the following uses: both the upper, large and lower, small pockets attached to the blanket body; the use of the upper, small pocket only; the use of the lower, large pocket only; the removal of upper, small pocket and lower, large pocket, only using the blanket body which can essentially serve as a traditional blanket; the use of one or both upper or lower liner, which serves as a layering system, combining an innovative design with high-quality fabrics, for example breathable cotton and organic fabrics, to create the ideal layering system for year around comfort in both in outdoor and indoor temperatures; removal of one or both of the upper or lower optimal liners.

A snapping system of the present invention can vertically line both sides of a body of the wearable blanket to allow for additional customization for the ideal fit to the child, which means the present invention will not only fit better, but serve longer as the child grows. This added feature means, parents and care givers can customize the wearable blanket in a matter that best suits the child's size and their lifestyle, preferences and needs.

The present invention also allows for a quick and easy application and use, allowing the wearable blanket to be applied whether the child is sitting, standing or reclining.

The design of the present invention addresses an unmet safety need through the creation of a product that does not come between the child and its safety, presenting new standards, awareness and choice rivaling the leading products in the children blanket space.

The invention will be more fully described by reference to the following drawings.

DETAILED DESCRIPTION

Figure 1:
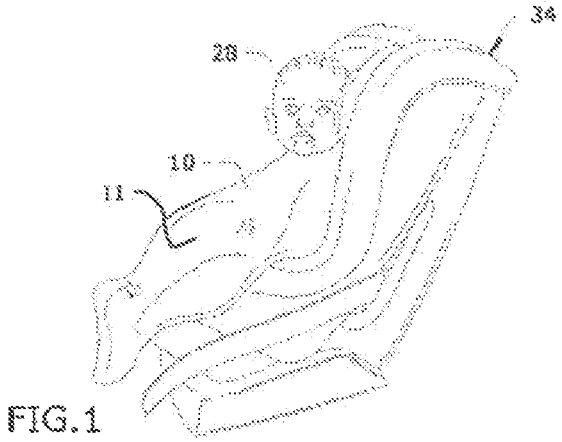
FIG. 1 shows a perspective view of the present invention with an exemplary baby seated in car seat covered with the wearable blanket.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 shows a perspective view of the present invention with an exemplary baby 28 seated in car seat 34 covered with wearable blanket 10.

Figure 2:
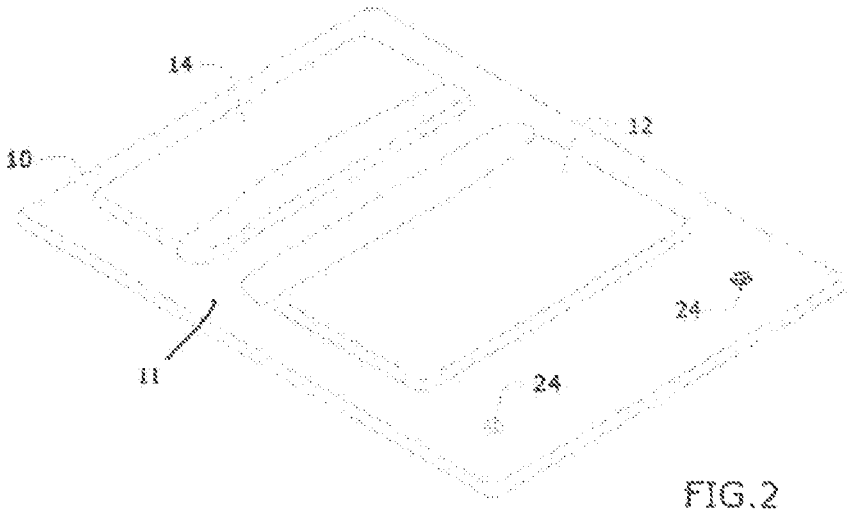
FIG. 2 shows a perspective interior view of the wearable blanket of the present invention.

FIG. 2 shows a perspective interior view of the present invention comprising an article of material which serves as wearable blanket 10. Wearable blanket 10 includes blanket body 11. Blanket body 11 can include at least one or both of upper pocket 14 and lower pocket 12. Female snaps 24 are positioned on blanket body 11 at pre-determined positions to adjust the positioning of upper pocket 14 and lower pocket 12 on blanket body 11.

Figure 3:
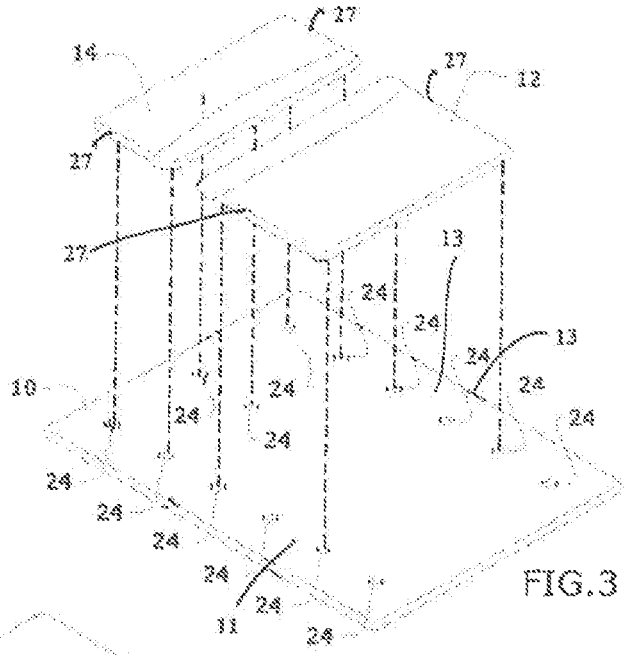
FIG. 3 shows an exploded view of the interior of the wearable blanket of the present invention.

FIG. 3 shows an exploded view of the present invention with upper pocket 14 and lower pocket 12 suspended revealing a full view of female snaps 24 that run vertically along each side 13 of blanket body 11 allowing both upper pocket 14 and lower pocket 12 to be adjusted to the right fit, and further customized by removing none, one or both upper pocket 14 and lower pocket 12.

Figure 4:
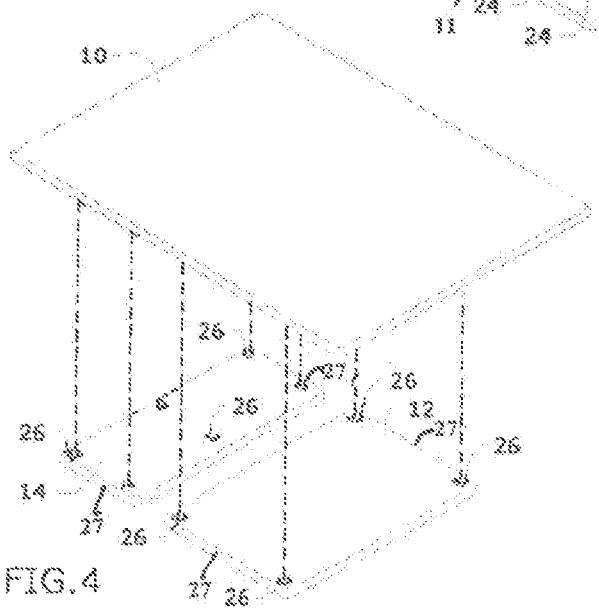
FIG. 4 shows an exploded view of the exterior of the wearable blanket of the present invention.

FIG. 4 shows an exploded view of upper pocket 14 and lower pocket 12 facing down revealing male snaps 26 along vertical edges 27 of upper pocket 14 and lower pocket 12. Male snaps 26 can be joined to female snaps 24.

Figure 5A:
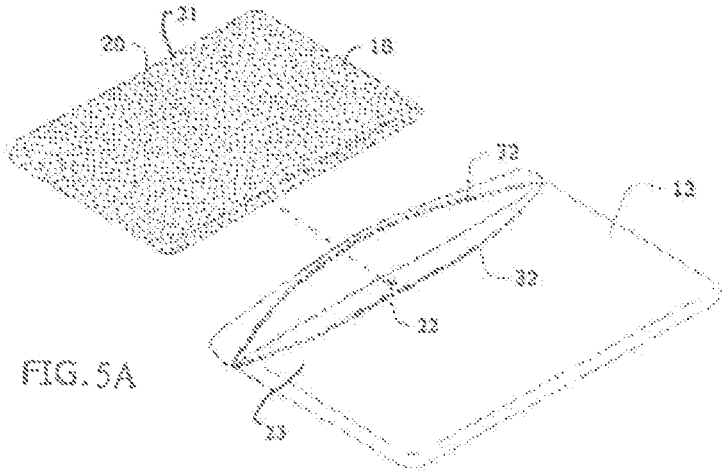
FIG. 5A shows an exploded view of a liner received in a lower pocket coupled to the wearable blanket.

FIG. 5A shows an exploded view revealing liner 18 being removably received in lower pocket 12. To ensure liner 18 remains fixed after being inserted into lower pocket, liner snap 20 positioned on top 21 can be coupled to pocket snap 22 on interior face 23 of lower pocket 12 so that liner 18 can be secured for added warmth or unsnapped to remove. Lower pocket 12 is seamlessly closed with pocket zipper 32 that is zipped and unzipped horizontally from left to right.

Figure 5B:
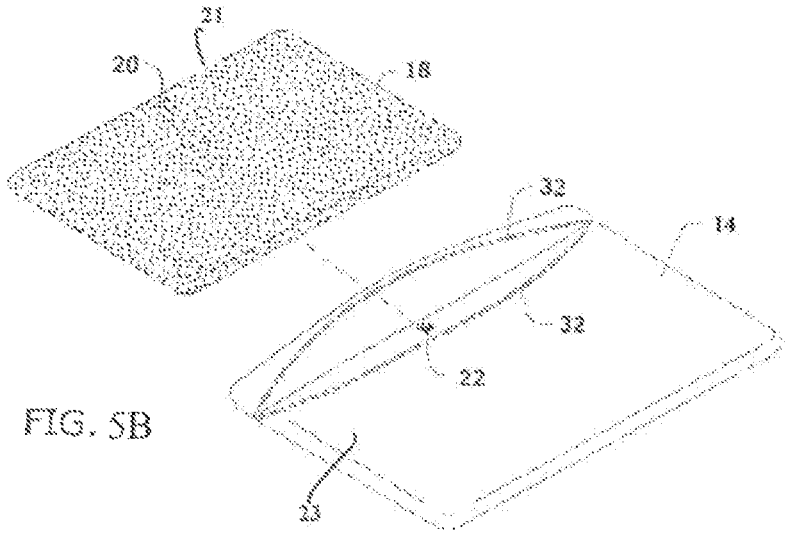
FIG. 5B shows an exploded view of a liner received in the upper pocket coupled to the wearable blanket.

FIG. 5B shows an exploded view revealing liner 18 contained in upper pocket 14. To ensure liner 18 remains fixed, liner snap 20 positioned on top 21 can be coupled to pocket snap 22 on interior face 23 of upper pocket 14 so that liner 18 can be secured for added warmth or unsnapped to remove. Upper pocket 14 is seamlessly closed with pocket zipper 32 that is zipped and unzipped horizontally from left to right. Upper pocket 14 can be constructed adjusted for smaller or larger dimensions than lower pocket 12. For example, upper pocket 14 can have a length in the range of about 6½ inches to about 16½ inches and a width in the range of about 9 inches to about 18 inches and lower pocket can have a length in the range of about 4½ inches to about 16½ inches and a width in the range of about 7 to about 18 inches.

Figure 6:
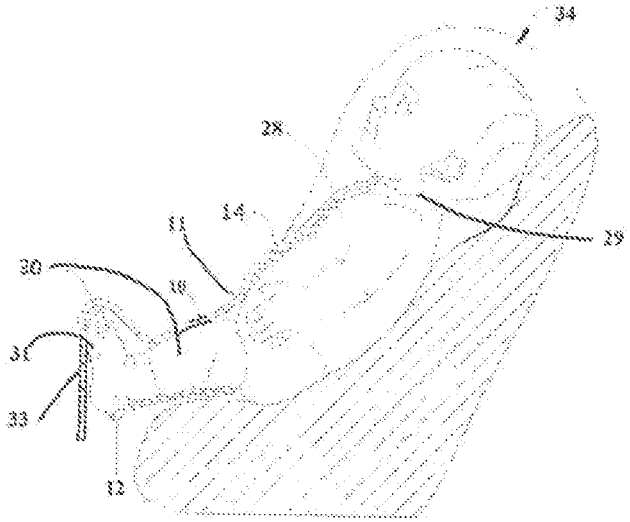
FIG. 6 shows a section view of the wearable blanket of the present invention worn by an exemplary baby in the seated position in the car seat.

FIG. 6 shows a section view of wearable blanket 10 worn by the exemplary baby 28 in the seated position in car seat 34 demonstrating how wearable blanket 10 covers from under neck 29 with upper pocket 14 for covering torso 28 and over legs 30 and feet 31. Legs 30 are received behind body 11 and in front of lower pocket 12. Feet 31 are not placed inside of lower pocket 12. Instead, legs 30 are placed in space 35 between lower pocket 12 and blanket body 11. Lower portion 33 of wearable blanket 10 covers feet 31. Therefore, the wearable blanket is configured to receive legs of a user behind a rear surface of blanket body 11 and between an inner surface of the lower pocket 12 and the rear surface of the body so that the rear surface of the blanket body and the inner surface of the lower pocket 12 are in contact with the user's legs for securing the wearable blanket to the legs of the user. This figures illustrates how the blanket secures to the legs, stopping just below the buttocks ensuring the baby is not sitting on any part of wearable blanket 10 and is not affixed, looped, or any anyway dependent on the seat, its fixture, seatbelt, or restraint system.

Figure 7:
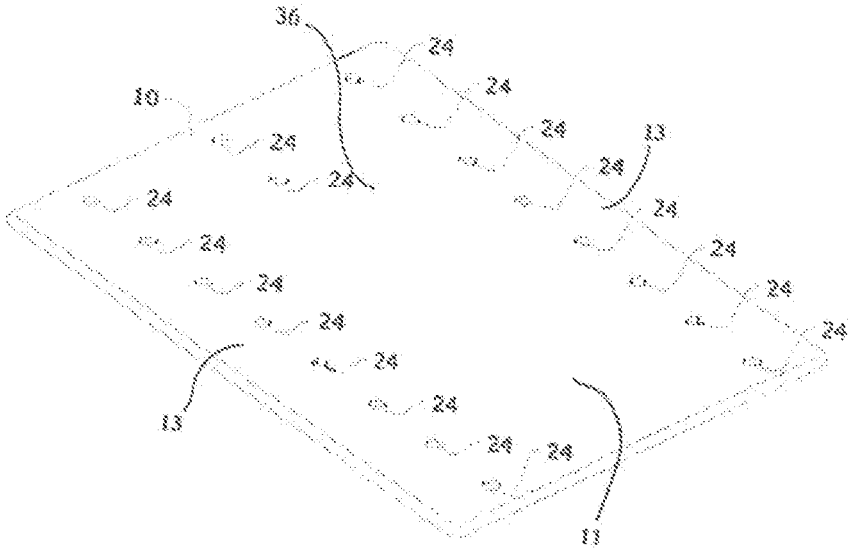
FIG. 7 is a top view of the wearable blanket with the upper and lower pockets removed.

FIG. 7 shows a perspective view of an alternate embodiment of wearable blanket 10 including blanket body 11 and eight female snaps 24 placed vertically down each side 13 and a plurality of female snaps 24 in middle 36 which serve to affix upper pocket 14 to blanket body 11.

Itemized Parts List

10: is the wearable blanket
11: is the blanket body
12: is the upper pocket
13: is the side
14: is the lower pocket
18: is the liner
20: is the liner snap
22: is the pocket snap
24: are the blanket female snaps
26: are the pocket male snaps
27: are the vertical edges of the pockets
28: is the exemplary baby
30: are the exemplary baby legs
31: are exemplary baby feet
32: are the pocket zippers
33: is a lower portion of the blanket
34: is the car seat
36: is the middle of the blanket It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention

What is claimed is:

1. A wearable blanket comprising:

a body;

a first pocket snapped to a rear surface of the body only along vertical edges of the first pocket;

a second pocket snapped to the rear surface of the body along vertical edges of the second pocket;

wherein the first pocket and the second pocket are snapped to the rear surface of the body with a snapping system, wherein the snapping system comprises a plurality of snaps placed vertically along each side of the body mating with a plurality of snaps on the vertical edges of the first pocket and the second pocket, the plurality of snaps along each side of the body and the plurality of snaps on the vertical edges of the first pocket and the second pocket being positioned at pre-determined positions to adjust the positioning of the first pocket and the second pocket;

a first liner received in the first pocket, wherein the first liner is formed of a warming fabric;

a second liner received in the second pocket, wherein the second liner is formed of a warming fabric;

wherein the wearable blanket is configured to receive legs of a user behind the rear surface of the body of the wearable blanket and between an inner surface of the first pocket and the rear surface of the body so that the rear surface of the body of the blanket and the inner surface of the first pocket are in contact with the user's legs for securing the wearable blanket to the legs of the user and a lower portion of the body covers the user's feet and wherein the first pocket is snapped with the snapping system to removably position the first pocket below the buttocks of the user so that the wearable blanket is configured to prevent the user from sitting on the wearable blanket with the buttocks of the user and the second pocket is configured to be positioned adjacent a chest of the user when the legs of the user are received between the rear surface of the body and the inner surface of the first pocket;

wherein the first pocket further comprises a zipper, the zipper being moved to open and close the first pocket;

wherein the first liner is removably coupled to an interior face of the first pocket;

wherein a first liner snap is coupled to the first liner and a first pocket snap is coupled to the first pocket, the first liner snap being removably coupled to the first pocket snap;

wherein the second pocket further comprises a zipper, the zipper being moved to open and close the second pocket;

wherein in the second liner is removably coupled to an interior face of the second pocket; and wherein a second liner snap is coupled to the second liner and a second pocket snap is coupled to the second pocket, the second liner snap being removably coupled to the second pocket snap.

2. The wearable blanket of claim 1 wherein the plurality of snaps along each side of the body are female snaps and the plurality of snaps on the vertical edges of the first pocket are male snaps, the female snaps mating with the male snaps.

* * * * *